United States Patent [19]

Kroll

[11] 4,351,316

[45] Sep. 28, 1982

[54] COMBUSTION APPARATUS FOR BURNING WASTE OILS

[76] Inventor: Walter Kroll, 42 Burgstaller Strasse, 7141 Kirchberg, Fed. Rep. of Germany

[21] Appl. No.: 82,860

[22] Filed: Oct. 9, 1979

[51] Int. Cl.[3] ..... F24C 5/00

[52] U.S. Cl. ..... 126/93; 431/79; 431/336

[58] Field of Search ..... 431/64, 336–340; 126/93, 94, 95

[56] References Cited

U.S. PATENT DOCUMENTS

| | | | |
|---|---|---|---|
| 2,091,487 | 8/1937 | Peoples | 431/336 |
| 2,240,861 | 5/1941 | Sabins | 431/337 |
| 2,351,481 | 6/1944 | Breese | 431/340 |
| 2,355,436 | 8/1944 | Hayter | 431/339 |
| 2,519,241 | 8/1950 | Findley | 126/93 |
| 2,716,405 | 8/1955 | Nelson | 126/93 |

*Primary Examiner*—Carroll B. Dority, Jr.

[57] ABSTRACT

Combustion apparatus for burning waste oils of various viscosities with high combustion efficiency and which can meet strict polution regulations comprises primary and secondary combustion chambers with the secondary combustion chamber located above the primary combustion chamber and the primary combustion chamber located within an outer housing so as to define between the outer housing and the primary combustion chamber a plenum space. An air blower delivers air to the plenum space which feeds air into the primary combustion chamber through air inlet openings in its side wall. The primary combustion chamber has a burner bowl provided at its base and a burner ring disposed above the burner bowl. Oil is supplied at a constant rate to the burner bowl via a positive displacement pump. The burner ring features a central aperture and two concentrically disposed rings of orifices with the orifices of the outer ring being of larger diameter than the orifices of the inner ring. The air inlet openings in the sidewall of the primary combustion chamber comprise a first set located below the burner ring and a second set located adjacent the top edge of the primary combustion chamber above the burner ring. The second set of air inlet openings are preferably relatively smaller and more numerous than the first set. In operation the oil supplied to the burner bowl vaporizes and the flame pattern produced by the burner ring cooperates with the arrangement of air inlet openings to produce stable burning conditions for a wide variety of fuels.

28 Claims, 7 Drawing Figures

Figure 1:
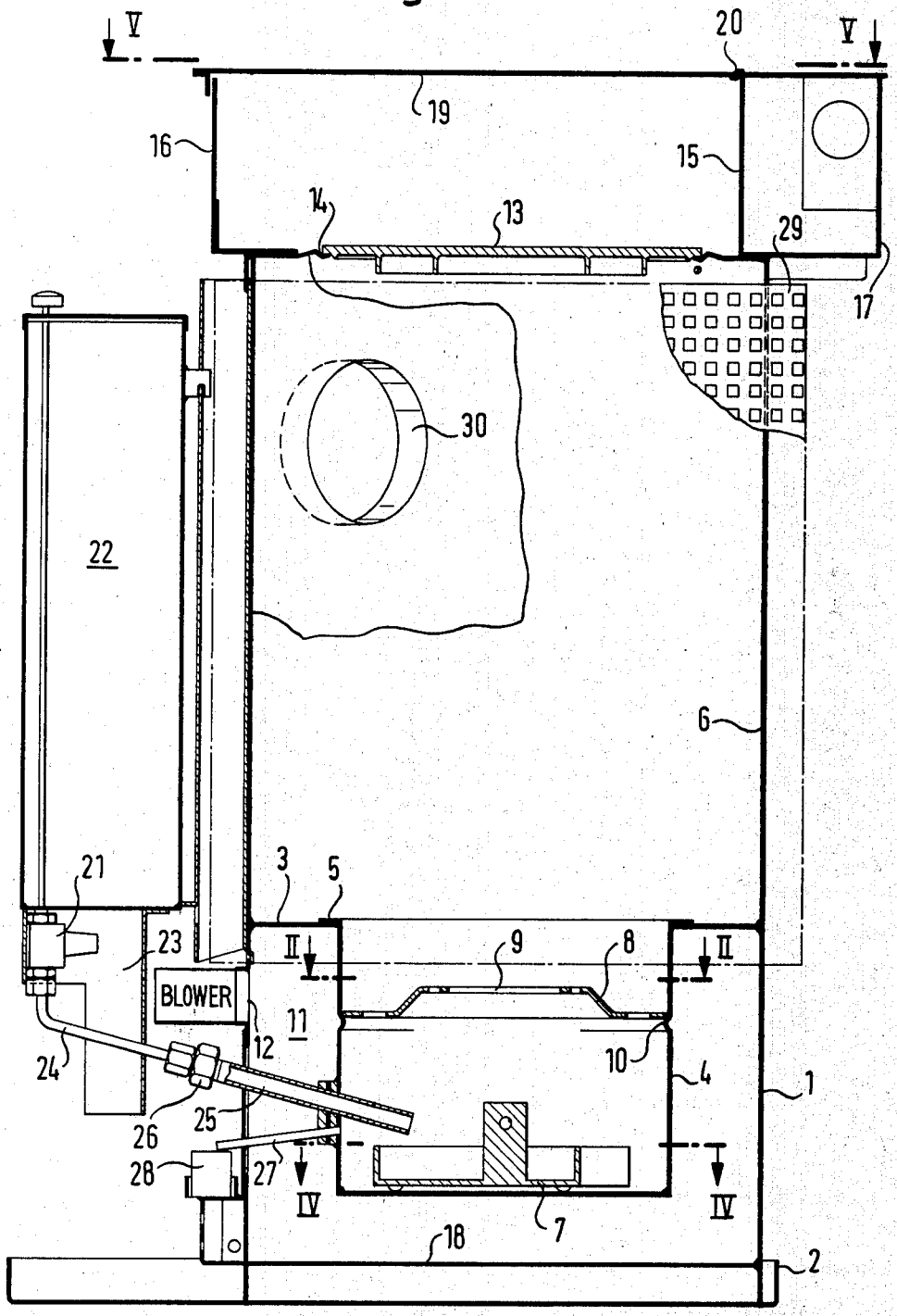

PROCESSING CIRCUITRY
PHOTOCELL OUTPUT SIGNAL
START SIGNAL
FIRST DELAY 25S
SECOND DELAY 20S
47
46
13
42
43
45
44
6
THERMO-STAT
OVERFLOW MONITOR
MOTOR
START
POWER SUPPLY
CONTROLLED SWITCH
CONTROLLED SWITCH

COMBUSTION APPARATUS FOR BURNING WASTE OILS

The present invention relates to combustion apparatus and has particular reference to a stove suitable for burning waste oils.

A known stove of the above kind comprises a primary combustion chamber having air inlets in which is situated a burner bowl above which there is located a burner ring. A secondary combustion chamber of larger diameter than the first is joined to the primary combustion chamber and oil is supplied to the burner bowl from a supply tank via a closable supply duct. Automatic overflow protection is provided in case oil should accumulate beyond the normal level within the burner bowl. In operation oil located within the burner bowl burns and the burner ring operates to stabilize the flame which extends into the secondary combustion chamber.

Such stoves have proved useful but the relatively simple nature of the combustion process has been such that prior art stoves find increasing difficulty in meeting the ever stricter combustion control regulations which seek to reduce air pollution.

The problem of meeting these regulations is particularly acute when one considers that stoves for burning waste oil should preferably be capable of burning a wide range of waste oils depending on what sort of waste oil is at any one time available. As available oils can range from very heavy gear oils to lighter engine oils and even lighter parafin fractions it will be appreciated that a stove which provides satisfactory burning for one fuel may encounter difficulties in providing satisfactory combustion of another fuel of a different viscosity range or which is heavily contaminated.

During times at which waste oil is in short supply it may also be desirable to operate the stove on normal domestic heating oil or a mixture of waste oils and domestic heating oil.

It will be understood therefore that a stove for burning waste oil is in general an attractive proposition only if it is capable of satisfactorily burning a wide range of fuels and meeting the prevailing regulations irrespective of which particular fuel is being burned. It would of course be possible for the user to mix waste fuels to produce fuel of a constant viscosity which would then offer better prospects for a consistent combustion process but this is clearly very tiresome and should thus be avoided.

Thus a prime object of the present invention is to provide combustion apparatus for burning waste oil which achieves clean combustion with a wide variety of fuels. Another principal object of the invention is to provide combustion apparatus of simple straightforward and reliable construction which can be economically manufactured and is simple to use. A further principal object of the present invention is to provide combustion apparatus of the above type which through adjusted clean combustion allows a high output to be achieved and which thereby guarantees a high degree of reliability. Further objects of the present invention include the provision of combustion apparatus which can be readily dismantled for service and cleaning purposes and which can be readily modified for a number of heating requirements. Yet further objects and aims of the present invention will become clear from the further description and claims.

For accomplishing the above objects the present invention envisages a basic combustion apparatus for burning oil and in particular waste oil, and comprising primary and secondary combustion chambers, the secondary combustion chamber being located above the primary combustion chamber with the primary combustion chamber located within an outer housing to define therebetween a plenum space, the primary combustion chamber having air inlet openings in its side wall and containing a burner bowl and a burner ring disposed above the burner bowl, wall means sealing said plenum chamber relative to the secondary combustion chamber, a blower capable of maintaining said plenum space at an elevated pressure, an oil supply tank, an oil supply duct leading from the tank to the burner bowl, a motor driven positive displacement pump in the oil supply duct for metering the flow of oil to the burner bowl and an oil overflow protection device associated with the primary combustion chamber.

The use of a blower and the sealed plenum space means that a steady flow of air to the combustion process is ensured so that stable burning conditions occur and this is the first prerequisit for ready compliance with the presently prevailing strict anti-pollution regulations.

In accordance with a specially preferred embodiment of the invention the burner ring is provided with at least two rings of orifices concentrically arranged with said substantially central aperture and the orifices of the inner of said two rings being of smaller area than the orifices in the outer of said rings.

It has been found that this arrangement produces stable burning conditions for a wide range of waste oil fuels.

Preferably the burner ring is located within the primary combustion chamber and is spaced from the top edge thereof and the air inlet openings in the side wall of the primary combustion chamber comprise a first set of air inlet orifices arranged below the burner ring and a second set of orifices disposed above the burner ring adjacent the top edge of the primary combustion chamber. The orifices of the second set are preferably more numerous and smaller than those of the first set.

The additional supply of uniformly distributed combustion air through said second set of air inlet orifices cooperates with the flame pattern produced by the burner ring to ensure a combustion process which results in relatively low levels of obnoxious exhaust gases. Furthermore this beneficial combustion process has been found to be effective for a wide range of waste oil fuels.

In one useful form the burner ring is of plate shape so that its centre is raised relative to the flange edge of the plate. In an arrangement of this kind the outer ring of orifices is provided in the flange edge of the plate and the inner ring and the centrally disposed aperture are located in the base of the plate. This arrangement not only results in a stiffening of the burner ring, enabling it to better withstand the heat generated during the combustion process without deflecting but also the disposition of the first and second rings of orifices relative to each other and relative to the air inlet openings in the wall of the primary combustion chamber results in a favourable combustion process.

Usefully the second combustion chamber is of greater diameter than the primary combustion chamber and is separated therefrom by a transverse annular wall which seals the secondary combustion chamber from the plenum space.

The base of the outer housing usefully sits within an oil catch tank of greater size than the outer housing and which extends beneath the oil supply tank, the oil supply duct, the motor driven positive displacement pump and the oil overflow protection device. In this way oil drips are retained.

This arrangement further features a transverse wall disposed within the outer housing beneath the primary combustion chamber and spaced therefrom and also from the base of said catch tank. The transverse wall not only seals the plenum chamber but also prevents heat radiated from the walls of the primary combustion chamber vaporizing the oil accumulating in the catch tank which would otherwise have been caught up with the airflow into the primary combustion chamber and have disadvantageously affected the combustion process.

In an arrangement of the kind described above it is useful for the burner bowl to have a cross-sectional area not substantially smaller than that of the primary combustion chamber. As the oil supply duct must extend over the burner bowl it then becomes very difficult to withdraw the burner bowl without tilting it. To avoid this the arrangement in accordance with the present invention features a burner bowl with a recess at one location around its periphery so that the burner bowl can be removed for cleaning purposes by rotating and vertically lifting without the need for tilting movements. The burner bowl is usefully spaced somewhat above the base of the primary combustion chamber by pedestal means.

Access to the combustion chambers is usefully provided by means of a removable cover at the top of the secondary combustion chamber. The removable cover preferably sits on the top of the secondary combustion chamber and forms a useful part of the heat dissipating means of the combustion apparatus.

To allow ready accessability to the centre of the primary combustion chamber the burner ring is usefully supported on step means projecting inwardly from the wall of the primary combustion chamber. It is thus clear that by removing the cover from the secondary combustion chamber both the burner ring and the burner bowl can be simply removed from the combustion apparatus.

In a modification the top end of the secondary combustion chamber is adapted to support an air blower and hood assembly. With this arrangement the air blower and hood cooperate to direct a flow of air across the removable cover so as to extract heat therefrom and to produce a flow of warm air for heating purposes.

In an arrangement of this kind it is useful for the hood to include a hinged lid which can be opened to permit removal of the cover and access to the primary and secondary combustion chambers.

Alternatively a heat exchanger can be substituted for the cover or placed on top of the cover so as to provide warm water for heating purposes.

A mantle of apertured sheet material is preferably arranged around the secondary combustion chamber and is spaced therefrom so as to define a space which enables air to flow upwardly past the secondary combustion chamber. The air circulation will of course take place by purely natural means because of the temperature of the secondary combustion chamber but can also be induced by the air blower and hood assembly in such a way that the air blower then blows the pre-warmed air over the relatively hotter cover.

It has been found particularly useful to chromium plate at least the internal surface of the part of the oil supply duct leading directly to the burner bowl and preferably also the outer surface of this part of the oil supply duct. In this way sediment etc. is less likely to accumulate on the oil supply tube and the heat reflecting property of the tube means that oil encrustation is less likely to occur or at least takes place at a slower rate.

Figure 2:
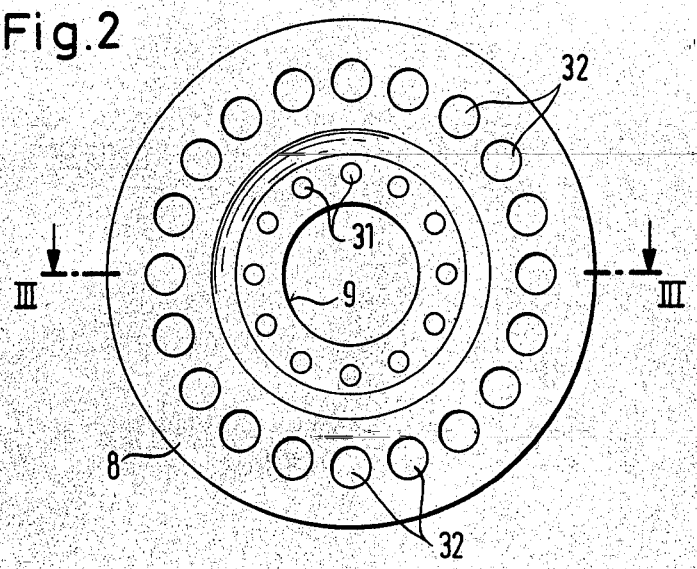
Figure 3:
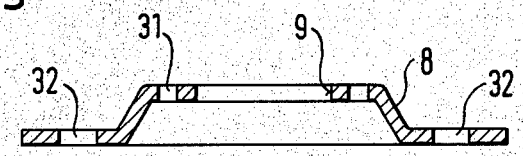
Figure 6:
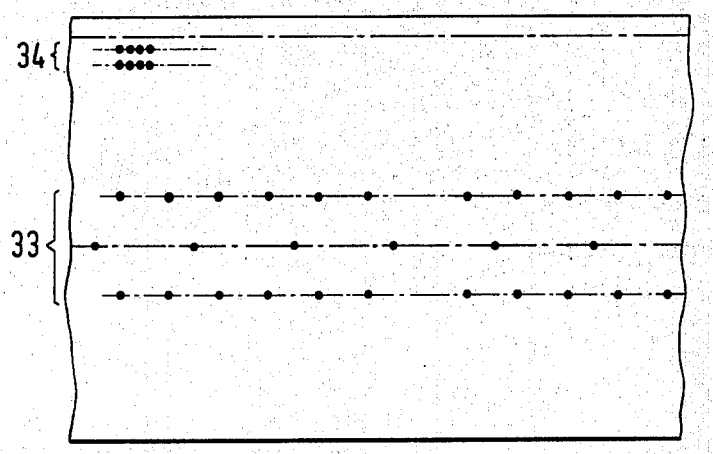
Figure 4:
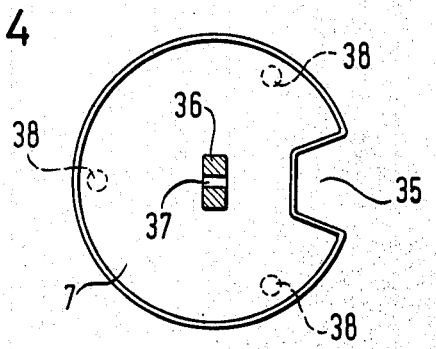
Figure 5:
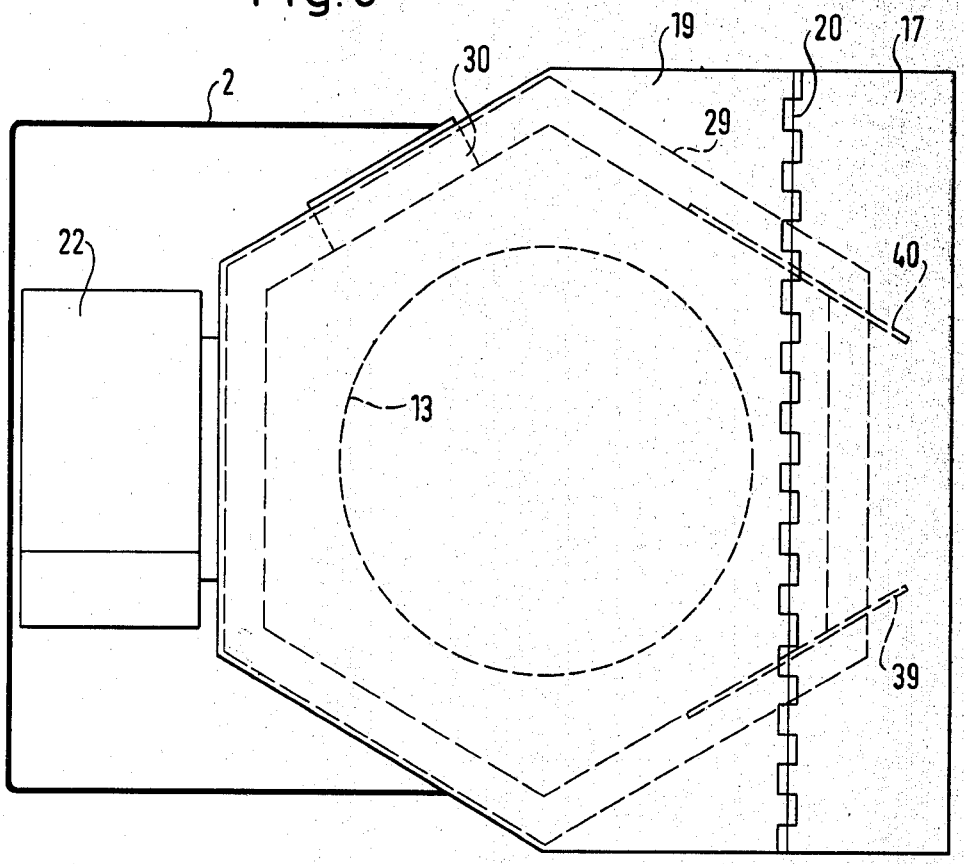

An example of a combustion apparatus in accordance with the present invention will now be specifically described by way of example only and with reference to the accompanying drawings in which:

FIG. 1 shows a schematic partially sectioned representation of combustion apparatus in the form of a stove for burning waste oil, FIG. 2 shows a plan view of a burner ring incorporated in the combustion apparatus of FIG. 1 as seen in the direction II—II of FIG. 1, FIG. 3 is a view in the direction III—III of FIG. 2, FIG. 4 is a plan view of a burner bowl incorporated in the combustion apparatus of FIG. 1 as viewed in the direction IV—IV of FIG. 1, FIG. 5 is a plan view in the direction V—V of FIG. 1, and FIG. 6 is a developed view of the wall of the primary combustion chamber of FIG. 1 showing the distribution of air inlet openings.

Figure 7:
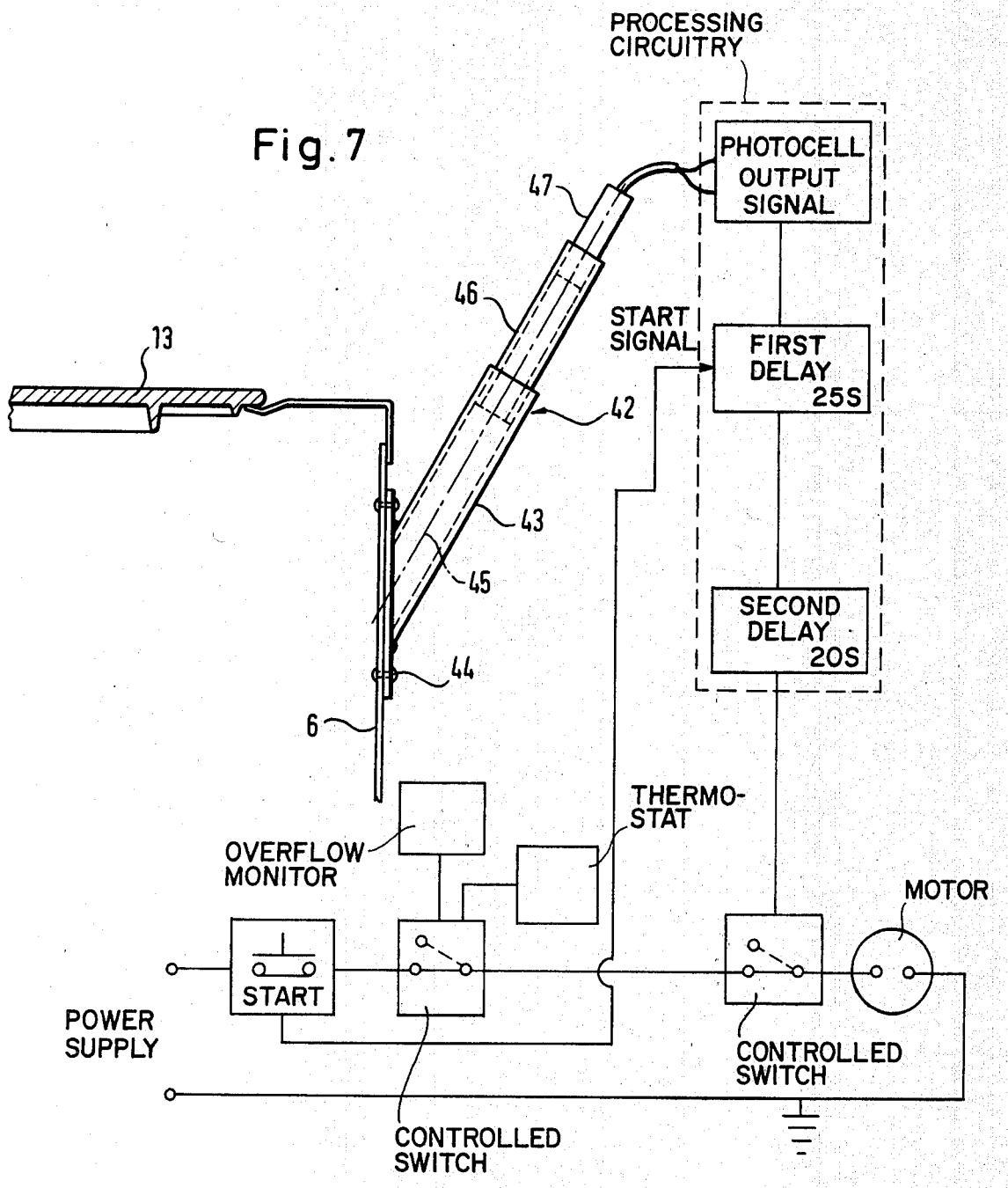

FIG. 7 illustrates the arrangement of a flame monitor suitable for use with the present combustion apparatus.

Referring now specifically to FIG. 1 of the drawings there can be seen a schematic representation of a stove suitable for burning waste oil. The stove basically comprises a tubular housing 1 which can be of circular or polygonal form and the lower edge of which sits within a catch tank 2.

Inside the tubular outer housing there is provided a transverse annular wall 3 and a primary combustion chamber 4 in the form of a burner pot is supported by an annular flange 5 on the transverse annular wall and extends downwardly beneath the wall. A secondary combustion chamber 6 is located above the primary combustion chamber and separated therefrom by the transverse annular wall 3. A burner bowl 7 is situated on the base of the primary combustion chamber 4 and a burner ring 8 with a substantially centrally disposed aperture 9 is located above the burner bowl on a rim or step defined by an annular indentation 10 in the wall of the primary combustion chamber. As can be seen from the drawing a plenum space 1 is defined between the primary combustion chamber and the outer housing and air is supplied from an air blower (not shown but arranged alongside the combustion apparatus) into the plenum space 1 via the inlet 12. The plenum space is sealed from the secondary combustion chamber via the transverse annular wall 3 and the air delivered to the plenum chamber passes via air inlet openings provided in the wall of the primary combustion chamber into the primary combustion chamber. The arrangement of these air inlet openings will be later described with reference to FIG. 6. It suffices for the present to say that the air inlet openings comprise a first set disposed around the periphery of the wall of the primary combustion chamber beneath the burner ring and a second set above the burner ring. The secondary combustion chamber 6 is closed at its top end by a removable cover 13 which sits on an annular sealing lip 14. In operation the removable cover 13 receives heat from the combustion process and this heat can be transferred either by radiation to the surroundings or, as shown in FIG. 1, an arrangement comprising a hood 15 with air vents 16 at its front end and a further air blower 17 are supported at the top end of the secondary combustion chamber. The further air blower 17 and the hood thus cooperate to duct a flow of air over the top of the cover 13 and are able to discharge the heated air through the slits at the side edge of the hood. The hood features a hinged cover 19 which can be hinged upwardly about the hinge 20 so as to allow ready access, after removal of the removable cover 13, to the inside of the primary and secondary combustion chambers.

A motor driven positive displacement pump 21 in the form of a gear pump is provided at the base of the large oil supply tank 22 and serves to meter the quantity of oil supplied through the oil supply duct 29, 25 to the burner bowl 7.

The pump function is one of metering rather than of pumping because the pressure head in the waste oil tank would suffice to drive the oil into the oil supply duct 24. The use of the positive displacement pump however ensures that the rate of supply of oil is constant and independent of the consistency of the oil.

The positive displacement pump can be driven by the motor in either of two power ranges via an appropriate transmission (not shown but of the kind already known per se), provided between the pump and the pump motor. The pump motor aggregate 21 is preferably fastened to a carrier 23 connected to the oil tank 22.

The oil supply duct in the illustrated example is constructed in two parts 24, 25 and it is important that the part 25 which passes into the first combustion chamber and opens over the burner bowl is straight so that cleaning of the duct is considerably simplified. Cleaning can for example take place by undoing the threaded connection 26 and inserting a spiral wound brush through the inside of the duct part 25. Preferably the interior and exterior surfaces of the duct part 25 are chromium plated so that the resulting smooth surfaces are less susceptible to accumulating dirt and tend to reflect heat so that the oil does not cake onto the surfaces and so that cleaning is considerably easier.

An overflow duct 27 leads from the primary combustion chamber to an overflow protection device 28 which is fitted with a micro switch at its end. The catch tank 2 is able to receive any oil that may overflow or drip from any of the component parts.

A transverse wall 18 passes across the base of the outer housing between and spaced from the base of the primary combustion chamber and the catch tank. The wall 18 is welded to the outer housing 1 and forms a seal which prevents heat reaching and vaporizing oil collecting in the catch tank which would otherwise disadvantageously affect the combustion process. The transverse wall also prevents oil in the catch tank from being stirred up by the incoming airflow and its closeness to the base of the primary combustion chamber improves the airflow around the base thereof. A mantle 29 of apertured sheet metal surrounds the secondary combustion chamber and is conveniently of matching cross-section i.e. either circular, polygonal or hexagonal as the case may be. The mantle is spaced from the secondary combustion chamber and reduces the heat lost by radiation whilst simultaneously promoting better hot air circulation.

An exhaust duct 30 is provided in the rear wall of the primary combustion chamber, as can be seen from the cut away section of FIG. 1, and extends through the mantle 29. The exhaust duct then leads to a chimney for passing the exhaust gases to atmosphere.

In operation the oil supplied to the burner bowl collects as a small puddle and is vaporized by the temperature prevailing inside the combustion pot. As the puddle vaporizes it is replaced with new oil via the supply duct 25. The burner ring serves to stabilize the flame and features a number of apertures, which will be later described in more detail, which distribute the flame so as to provide effective burning of a wide range of waste oils. The burner ring 8 can be seen in more detail by referring also to FIGS. 2 and 3. It will be noted that the burner ring is of generally plate-like shape and has two rings of orifices 31, 32 arranged substantially concentrically with the central aperture. The orifices of the inner of the two rings are of smaller area than the orifices in the outer of said rings 31.

Whilst the generally plate-like shape of the burner ring is preferred it can also be flat without significant disadvantage to the combustion process. In a specific embodiment we have found it useful for the burner ring to be of 31.0 cm diameter and for the central aperture to be of 9.0 cm diameter. The orifices of the inner ring are preferably of 1.5 cm diameter and are arranged on a pitch circle of 13.0 cm diameter and are twelve in number. In contrast the orifices in the outer ring are 2.5 cm diameter, are arranged on a pitch circle of 24.0 cm diameter, and are 20 in number. The cone angle of the conical wall of the plate has an included angle of 60°.

Thus it will be seen that the preferred ratio of the areas of the inner ring of orifices to that of the outer ring of orifices is of the order of 2.8 to 1 but can conveniently lie in the range 1.5 to 3.5 to 1 without significant disadvantage. The numbers of the orifices in the individual rings can also be varied it is however beneficial to arrange for the orifices in the outer row to be pitched at distances less than three times their diameters and preferably less than twice their diameters and for the orifices of the inner ring to be fewer in number than those of the outer ring.

The distribution of orifices in the burner ring cooperates in favourable fashion with the sets of air inlet openings provided in the wall of the primary combustion chamber. A developed section of this wall can be seen from FIG. 6. It can be noted that the air inlet openings basically comprise a first set 33 arranged below the burner ring and featuring a pattern of three rows of regularly spaced orifices of 3.3 mm diameter. The mean spacing between the orifices is preferably 3.0 cm. The orifices are arranged in the pattern as shown and can conveniently be supplemented by a further row of orifices of slightly smaller diameter namely 2.5 cm provided above the three illustrated rows and staggered relative to the upper and lower rows. In general the distribution and size of the apertures is not critical but they should be located somewhere towards the middle region of the primary combustion chamber wall. A second set of orifices 34 is also provided the orifices being of 2.5 mm diameter and arranged at a pitch of 6 mm. The second set of inner orifices are thus smaller and more numerous. Again the number of rows and the precise distribution and size of orifices can be varied from the specific arrangement shown although this is the preferred arrangement. For best effects the second set of orifices should be provided adjacent the top edge of the primary combustion chamber. The general arrangement of the air inlet openings as described cooperates in beneficial fashion with the rings of orifices in the burner ring to promote good combustion for a wide range of waste oil fuels.

Turning now briefly also to FIGS. 4 and 5 there can be seen further details of the invention. In particular, as shown in FIG. 4, the burner bowl can be seen to have a recess 35 at one portion around its periphery. This recess enables the burner bowl to be lifted vertically out of the primary combustion chamber past the oil supply duct 25 without the need to tilt the burner bowl. This prevents oil spilling into the space of the primary combustion chamber which could otherwise be awkward to remove. It will be noted that the burner bowl 35 features a central upstanding post 36 with a transverse bore 37. The cranked end of a lifting rod can be inserted into this transverse bore 37 and its length is such that the burner bowl can conveniently be rotated and vertically lifted by means of the lifting rod. The burner bowl preferably has three pedestals 38 provided at its underside by means of which it can be spaced slightly above the base of the primary combustion chamber.

The plan view of FIG. 5 enables the hinge position 20 of the hood of the hood and blower assembly to be recognized and also two support arms 39 and 40 which are bolted to the side of the secondary combustion chamber 4 and which are adapted to support the blower and hood arrangement.

Turning finally to FIG. 7 there can be seen a flame monitor 42 the primary function of which is to monitor the presence of a flame in the primary combustion chamber and to act as a safety system to shut off the oil supply if for some reason the flame should fail. Such flame monitors are known per se in connection with heating stoves for burning domestic oil and the mere concept of using such a flame monitor in combination with combustion apparatus for burning waste oil is not in itself an inventive feature. The specific arrangement of FIG. 7 is however particularly advantageous and meritorious because it overcomes a number of the specific difficulties which are associated with combustion apparatus for burning waste oil but which would not occur with apparatus for burning domestic heating oil.

As can be seen from FIG. 7 the flame monitor 42 is mounted towards the top end of the secondary combustion chamber 6 and is attached to its sidewall 6 just below the removable cover 13. The flame monitor is conveniently positioned above the oil supply tank 22 of FIG. 1. The flame monitor is basically a tubular assembly and features a steel tube 43 which is attached to the sidewall of the secondary combustion chamber 6 via a mounting flange 44. The mounting flange and tube are arranged so that the axis 45 of the tube when projected passes through the center of the centrally disposed aperture 9 in the burner ring 8. A ceramic tube 46 is partially inserted into the end of the steel tube 43 and a flame monitoring photocell 47, which can be of the cadmium type well known in connection with domestic stoves, is inserted in similar fashion in the end of the ceramic tube 46. An aperture is provided in the sidewall of the secondary combustion chamber and in the mounting flange 44 so that the photocell 47 is actually able to "look" at the center of the centrally disposed aperture 9. This positioning is very important because it provides reliable information about the presence or absence of a flame in the primary combustion chamber. The location of the flame monitor 43 high up in the secondary combustion chamber and the protection of the photocell that is afforded by the tubular construction is particularly important in connection with a stove for burning waste oil. The likelihood is always present that for example water is present in the waste oil and suddenly vapourizes in the heat of the primary combustion chamber thus causing oil to spatter in the primary combustion chamber and up through into the secondary combustion chamber. The protected position of the photocell prevents its malfunction due to spattered oil. Furthermore the location is such that it is unlikely to be contaminated by smoke which may arise when the combustion apparatus is first lit. The ceramic tube 46 acts as a insulating member which prevents the heat of the warm walls of the secondary combustion chamber disadvantageously affecting the operation of the photocell. The photocell responds to the brightness of the flame in the combustion apparatus. Electrical control circuitry is associated with the photocell and enables it to stop the supply of oil to the primary combustion chamber if the flame should fail. This is done quite simply by enabling the change in output signal from the photocell to stop the motor driving the pump 21. The pump 21 being of the positive displacement kind acts conveniently as a valve which prevents the further discharge of oil from the oil tank 22 through the supply duct 24, 25. The circuitry includes first and second delay circuits. The second delay circuit allows a period of 20 seconds after the flame has apparently gone out to pass before switching off of the motor 21. This arrangement prevents fluctuation of the flame unnecessarily resulting in shutting down of the combustion apparatus. Similarly the first delay circuit assures that on lighting of the stove, which is achieved by introducing a burning oil soaked rag through the cover 13 into the burner bowl 7, initial flickering of the flame is not misinterpreted as extinction of the flame by the photocell. This delay is conveniently of about 25 seconds. The flame monitor works in addition to both the oil overflow monitoring system and a thermostat which automatically shuts down the supply of oil once the temperature in the primary combustion chamber drops below 45° C.

It will be appreciated by those skilled in the art that further modifications can be made to the arrangement herein disclosed without departing from the scope of the present teaching.

I claim:

1. Combustion apparatus for burning waste oils, comprising: a primary combustion chamber; a secondary combustion chamber located above said primary combustion chamber; an outer housing; said primary combustion chamber having a sidewall, a top edge and a base and being located in said outer housing to define therebetween a plenum chamber; wall means sealing said plenum chamber relative to said secondary combustion chamber; an air blower mounted outside said plenum chamber and capable of maintaining said plenum chamber at an elevated pressure; air inlet openings in said sidewall for admitting air from said plenum chamber to said primary combustion chamber; a burner bowl contained in said primary combustion chamber adjacent the base thereof; a burner ring; means positioning said burner ring above said burner bowl and below said top edge; an oil supply tank, an oil supply duct leading from said tank to said burner bowl, a motor driven positive displacement pump in said oil supply duct for metering the flow of oil to said burner bowl, and an oil overflow protection device for draining excess oil from the primary combustion chamber; said burner ring having a substantially central aperture and at least an outer ring of orifices and an inner ring of orifices substantially concentrically arranged relative thereto, the orifices of said inner ring being of smaller area than the orifices of said outer ring, and said air inlet openings comprise a first set of air inlet orifices arranged below said burner ring for supplying combustion air to the burner bowl and beneath said burner ring, and a second set of air inlet orifices disposed above said burner ring adjacent said top edge.

2. Combustion apparatus according to claim 1 and wherein said secondary combustion chamber is of greater diameter than said primary combustion chamber and is separated therefrom by said wall means, said wall means being in the form of a transverse annular wall.

3. Combustion apparatus according to claim 1 and in which said outer housing is of substantially tubular shape the base edge of which rests within an oil catch tank of greater size than said outer housing and extending beneath said oil supply tank, said oil supply duct, said motor driven positive displacement pump and said oil overflow protection device, there being further provided a transverse wall disposed within said outer housing beneath said primary combustion chamber and spaced from said primary combustion chamber and from the base of said catch tank.

4. Combustion apparatus according to claim 1, wherein said oil supply duct projects into said primary combustion chamber over said burner bowl and wherein said burner bowl comprises a substantially flat base section and side walls and includes a recess at one portion of its periphery whereby said burner bowl can be lifted vertically out of said primary combustion chamber without tilting past said oil supply duct.

5. Combustion apparatus according to claim 3 and in which said burner bowl is spaced somewhat above the base of said primary combustion chamber by pedestal means.

6. Combustion apparatus according to claim 1 and in which the upper end of said secondary combustion chamber is closable by means of a removable cover whereby to provide access to the inside of said secondary and primary combustion chambers whereby said burner ring and said burner bowl can be removed by straight forward vertical lifting through the upper end of said secondary combustion chamber.

7. Combustion apparatus according to claim 1, and wherein said means positioning said burner ring comprises a single annular rim formed in the wall of said primary combustion chamber.

8. Combustion apparatus according to claim 1 and in which the top end of said secondary combustion chamber is adapted to support a further air blower and hood assembly said hood and air blower cooperating to direct a flow of air across said removable cover whereby to extract heat therefrom and to produce a flow of warm air for heating purposes.

9. Combustion apparatus according to claim 8 and wherein said hood assembly includes a hinged lid openable to permit removal of said cover and access to said primary and secondary combustion chambers.

10. Combustion apparatus according to claim 1 and wherein said positive displacement pump and the driving motor therefor are fastened to the base of the oil supply tank.

11. Combustion apparatus according to claim 1 and wherein said positive displacement pump is a metering pump adapted to restrict the gravity flow of oil from said oil tank to said oil supply duct rather than to supply oil under the pressure thereto by pump action.

12. Combustion apparatus according to claim 1 and in which said oil supply duct comprises at least two parts and in which the part leading directly to the burner bowl is straight.

13. Combustion apparatus according to claim 12 and in which at least the interior surface of the part of the oil supply duct leading directly to the burner bowl has a polished reflecting surface.

14. Combustion apparatus according to claim 13 and in which the outer surface of said part of said oil supply duct leading directly to the burner bowl also has a polished reflecting surface.

15. Combustion apparatus according to claim 14 and wherein said polished reflecting surfaces comprises chromium plating.

16. Combustion apparatus according to claim 1 and in which said secondary combustion chamber is of hexagonal section and is surrounded by a mantle of apertured sheet material of corresponding section but spaced therefrom.

17. Combustion apparatus according to claim 1 and wherein the orifices of said second set are more numerous and smaller than those of said first set.

18. Combustion apparatus according to either of claims 1 or 17, and wherein said burner ring is of plate shape with said outer ring of orifices being provided in the flange edge of the plate and said inner ring of orifices and said substantially centrally disposed aperture being located in the base of said plate.

19. Combustion apparatus according to claim 8, and wherein a mantle of apertured sheet material surrounds said secondary combustion chamber and is spaced therefrom, and wherein said further air blower picks up air flowing between said mantle and said secondary combustion chamber.

20. Combustion apparatus according to claim 1, including a flame monitor for monitoring the presence of a flame, said flame monitor being mounted adjacent the upper end of the secondary combustion chamber and is directed so as to view substantially the center of said central aperture.

21. Combustion apparatus in accordance with claim 1, and wherein the ratio of the area of the inner ring of orifices to that of the outer ring of orifices lies in the range 1.5 to 3.5 to 1.

22. Combustion apparatus in accordance with claim 21, and wherein said ratio is 2.8 to 1.

23. Combustion apparatus in accordance with claim 1, and wherein said burner ring is of 31 cm diamenter, said central aperture is of 9 cm diameter, the orifices of the inner ring are of 1.5 cm in diameter are 12 in number and are arranged on a pitch circle of 13 cm diameter, and the orifices of the outer ring are 2.5 cm in diameter are 20 in number and are arranged on a pitch circle of 24 cm diameter.

24. Combustion apparatus in accordance with claim 21 and wherein said first set of air inlet orifices comprises three rows of regularly spaced orifices of 3.3 mm diameter with a mean spacing between the orifices of 3 cm and wherein said second set of air inlet orifices comprises two rows of orifices of 2.5 mm diameter arranged at a pitch of 6 mm.

25. Combustion apparatus according to claim 20 and wherein said flame monitor comprises a metallic tube with a flange for mounting onto the wall of said secondary combustion chamber, a ceramic tube inserted at least partially into said metallic tube and a photocell mounted at least partially in said ceramic tube.

26. Combustion apparatus according to claim 25 and in which said photocell is a cadmium cell as known per se and is responsive to light in the visible spectrum.

27. Combustion apparatus according to either of claims 20 or 25 processing circuitry for deriving a signal from said flame monitor indicative of extinction of the combustion apparatus and for applying said signal to stop said motor driven positive displacement pump.

28. Combustion apparatus according to claim 27 and wherein said processing circuitry includes first delay means for inhibiting stopping of the motor for an initial period during lighting of said combustion apparatus, second delay means for delaying the stopping of said motor following monitoring of apparent extinction of an established flame.

* * * * *